United States Patent [19]

Suenaga et al.

[11] Patent Number: 4,619,713

[45] Date of Patent: Oct. 28, 1986

[54] METHOD OF PRODUCING NODULAR GRAPHITE CAST IRON

[75] Inventors: Makoto Suenaga; Mitsuru Yano; Yasuoki Ishihara; Kohki Ohtsuka, all of Fukuoka, Japan

[73] Assignee: Hitachi Metals, Ltd., Tokyo, Japan

[21] Appl. No.: 538,821

[22] Filed: Oct. 5, 1983

[30] Foreign Application Priority Data

Feb. 25, 1983 [JP] Japan ..... 58-30471
Feb. 25, 1983 [JP] Japan ..... 58-30472

[51] Int. Cl.[4] ..... C21D 5/00

[52] U.S. Cl. ..... 148/3; 148/138; 148/139

[58] Field of Search ..... 148/3, 138, 35, 139; 75/123 CB

[56] References Cited

U.S. PATENT DOCUMENTS 3,784,416 1/1974 Davies ..... 148/3
3,860,457 1/1975 Vourinen et al. ..... 148/35
4,222,793 9/1980 Grindahl ..... 148/2
4,382,828 5/1983 Henych ..... 148/3

FOREIGN PATENT DOCUMENTS 2853871 7/1980 Fed. Rep. of Germany ..... 148/138
47-8338 5/1972 Japan ..... 148/138
4801478 5/1978 Japan .
4801578 5/1978 Japan .
9445980 7/1980 Japan .
57-89423 6/1982 Japan ..... 148/3

*Primary Examiner*—L. Dewayne Rutledge
*Assistant Examiner*—Deborah Yee
*Attorney, Agent, or Firm*—Finnegan, Henderson, Farabow, Garrett & Dunner

[57] ABSTRACT

A method of producing a nodular graphite cast iron having high strength and toughness in shorter time and with reduced production cost. The method comprises the following steps: rapidly cooling the casting, which has been removed from the mold at a predetermined temperature above the $A_1$ transformation point, at such a cooling rate as not to permit the generation of pearlite structure, after having been held for a predetermined time within the austenite temperature range or immediately after having been removed from the mold; once stopping the rapid cooling at a temperature above the Ms point; slowly cooling the casting within a temperature range above the Ms point for a predetermined time or holding the casting at a constant temperature within a predetermined temperature range above the Ms point for a predetermined time; and cooling the casting slowly down to the normal temperature.

8 Claims, 12 Drawing Figures

X400

X400

X400

X400

X400

X400

METHOD OF PRODUCING NODULAR GRAPHITE CAST IRON

BACKGROUND OF THE INVENTION

The present invention relates to a method of producing a nodular graphite cast iron and, more particularly, to a method of producing a nodular graphite cast iron having a high strength and a high toughness in its as-cast state.

Nodular graphite cast iron exhibits the highest toughness among various cast irons. The nodular graphite cast iron, however, exhibits a tensile strength in the level of around 80 $Kg/mm^2$ at the highest. It is quite difficult to obtain nodular graphite cast iron having high strength and toughness unless a specific heat treatment consisting of reheating, hardening and tempering is conducted after melting and casting of a specially selected material, or an austempering treatment as disclosed in Japanese Patent Publication No. 48014/78 is conducted.

Needless to say, the reheating of casting once cooled after having been removed from a mold naturally requires considerable energy. Thus, these known methods are not recommended not only from the view point of production cost but also from the view point of energy preservation.

Further, in order to obtain high strength and high toughness stability in the as-cast state, it is necessary to add large amounts of special elements such as Ni, Mo and Cu. These special elements are generally expensive and, hence, increase production costs.

Under these circumstances, such a method has been proposed that, in the course of the cooling after pouring and solidification of the molten metal in the mold down to the completion of $A_1$ transformation, the removal of casting from the mold is conducted as soon as possible after the solidification to rapidly cool the casting to increase the amount of pearlite in the matrix structure, thereby to improve the mechanical properties. However, the addition of pearlite stabilizers such as Mn, Sn and Cu is also necessary in this method. Even with the addition of these pearlite stabilizers, the cast iron produced by this method cannot have such high strength and toughness as would permit this cast iron to be used in place of forged material. Thus, this method is still unsatisfactory.

SUMMARY OF THE INVENTION

Under these circumstances, the present inventors have developed a novel technique in which the cooling rate of the melt after pouring into a mold, particularly the rate of cooling of the casting after having been removed from the mold, is suitably adjusted to obtain a desired structure and, hence, desired mechanical properties, without requiring addition of large amount of special elements.

Accordingly, it is a primary object of the invention to provide a method of producing a nodular graphite cast iron having a high strength and toughness, improved to shorten the production process and lower production costs.

To this end, according to the invention, there is provided a method of producing a nodular graphite cast iron in which a melt having a nodular graphite cast iron composition is poured into a mold and, after solidification, a casting is removed from the mold at a predetermined temperature above the $A_1$ transformation temperature and is then cooled rapidly, the method comprising: rapidly cooling the casting removed from the mold at such a cooling rate as not to permit the generation of pearlite structure, after having been held for a predetermined time within the austenite temperature range or immediately after having been removed from the mold; once stopping the rapid cooling at a temperature above the Ms point; slowly cooling the casting within a temperature range above the Ms point for a predetermined time or holding the casting at a constant temperature within a temperature range above the Ms point for a predetermined time; and cooling the casting down to the normal temperature.

The above and other objects, features and advantages of the invention will become clear from the following description of the preferred embodiments.

DESCRIPTION OF THE PREFERRED EMBODIMENT

The preferred embodiments of the invention will be described in detail hereinunder.

EMBODIMENT 1

The melt of nodular graphite cast iron having the following chemical composition (wt%) was prepared.

TABLE 1

| C | Si | Mn | P |
|---|---|---|---|
| 3.65 | 2.11 | 0.41 | 0.025 |
| **S** | **Cu** | **Mo** | **Mg** |
| 0.009 | 0.53 | 0.30 | 0.046 |

Figure 1A:
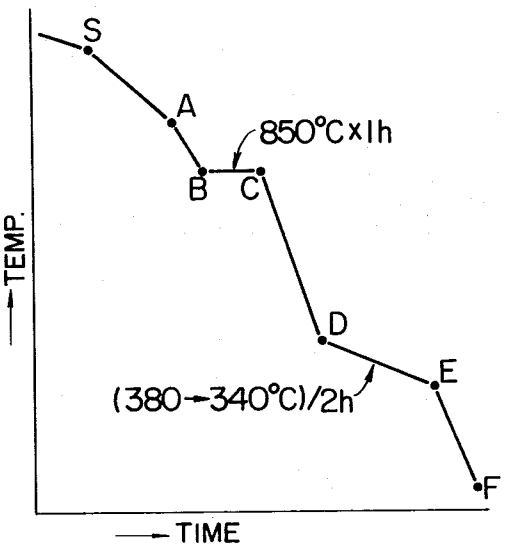
FIGS. 1*a*, 1*b* and 1*c* are graphs showing thermal histories of cast iron in accordance with a first, second and third embodiment of the invention, respectively.

This melt was poured into a sand mold having a casting cavity of 40 mm dia. and 300 mm long, at a temperature of 1400° to 1420° C. The casting after the solidification was treated in accordance with a thermal history as shown in FIG. 1*a*. Namely, the casting solidified at a point S was cooled within the mold down to a point A of 900° to 850° C. above the $A_1$ transformation point. Then, after having been removed from the mold, the casting is held within a heating furnace for 1 hour at a temperature of 850° C. which is within the austenite temperature range as shown by points B and C. Subsequently, the casting is rapidly cooled in the region between points C and D at such a cooling rate as not to permit the generation of pearlite structure. This rapid cooling is once stopped at a point D which is at 380° C. Thereafter, the casting is cooled slowly in two hours down to a point E (340° C.) which is above the Ms point. The casting is then cooled down to a point F which is at the normal temperature.

Test pieces were obtained from the thus treated casting, and were subjected to a mechanical testing the result of which is shown in Table 2 below.

TABLE 2

| tensile strength (kg/mm²) | yield strength (kg/mm²) | elongation (%) |
|---|---|---|
| 104.6 | 73.4 | 10.9 |
| 101.1 | 72.5 | 10.4 |

| Hardness (BHN) | impact strength (un-notched specimen) (kgf-m/cm²) |
|---|---|
| 302 | 9.73 |
| 293 | 10.66 |

Figure 3A:
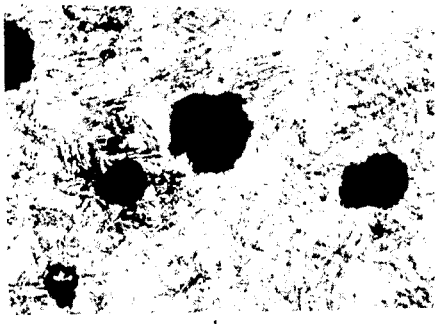
FIGS. 3*a*, 3*b* and 3*c* are photos of microstructures (magnification 400) of nodular graphite cast iron produced in accordance with the first, second and third embodiment of the invention, respectively.

This casting exhibited a microstructure as shown in FIG. 3*a*.

EMBODIMENT 2

The chemical composition (wt%) of the melt of nodular graphite cast iron was as follows.

TABLE 3

| C | Si | Mn | P |
|---|---|---|---|
| 3.58 | 2.14 | 0.44 | 0.026 |
| S | Cu | Mo | Mg |
| 0.009 | 0.30 | — | 0.051 |

Figure 1B:
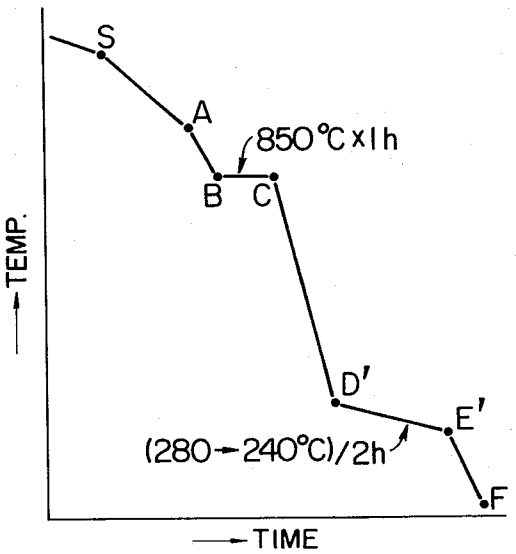

This melt was poured into a sand mold of the same size as Embodiment 1 at a temperature of 1400° to 1410° C. The casting after the solidification was subjected to the same heat treatment except that as shown in FIG. 1*b* the slow cooling between the points D′ and E′ was conducted from 280° C. to 240° C. in two hours. The result of a mechanical testing conducted with this casting is shown in Table 4 below.

TABLE 4

| tensile strength (kg/mm²) | yield strength (kg/mm²) | elongation (%) |
|---|---|---|
| 123.9 | 86.3 | 3.9 |
| 128.4 | 87.2 | 4.1 |

| Hardness (BHN) | impact strength (un-notched specimen) (kgf-m/cm²) |
|---|---|
| 388 | 5.31 |
| 401 | 4.67 |

Figure 3B:
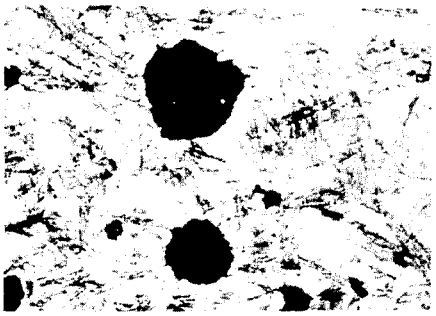

This casting exhibited a microstructure as shown in FIG. 3B.

EMBODIMENT 3

The chemical composition (wt%) of the melt of nodular graphite cast iron was as follows.

TABLE 5

| C | Si | Mn | P |
|---|---|---|---|
| 3.65 | 2.13 | 0.40 | 0.025 |
| S | Cu | Mo | Mg |
| 0.008 | 0.57 | 0.32 | 0.043 |

Figure 1C:
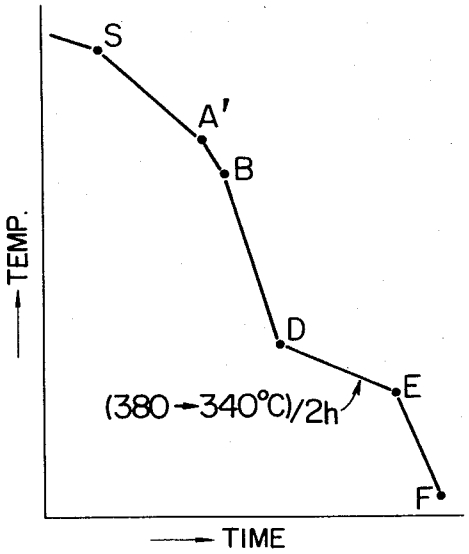

This melt was poured into a sand mold of the same size as Embodiment 1 at a temperature of 1400° to 1420° C. The casting after the solidification was cooled within the mold down to a point A′ which was at 870° C. as shown in FIG. 1*c* and, after having been removed from the mold, the casting was rapidly cooled immediately from the point B (850° C.) down to a point D at such a rate as not to permit the generation of pearlite structure, without being held at 850° C. for 1 hour, and was then treated in the same way as Embodiment 1.

The casting was subjected to a mechanical testing, the result of which is shown below.

TABLE 6

| tensile strength (kg/mm²) | yield strength (kg/mm²) | elongation (%) |
|---|---|---|
| 106.3 | 75.6 | 8.6 |
| 109.8 | 76.9 | 9.1 |

| Hardness (BHN) | impact strength (un-notched specimen) (kgf-m/cm²) |
|---|---|
| 311 | 8.63 |
| 321 | 8.31 |

Figure 3C:
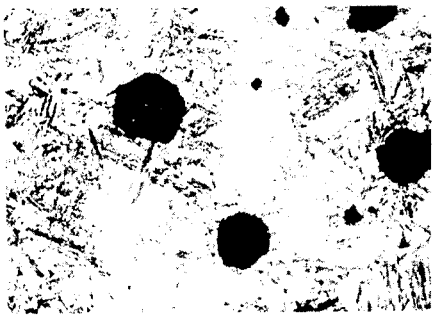

This casting had a microstructure as shown in FIG. 3*c*.

EMBODIMENT 4

The chemical composition (wt%) of the melt of nodular graphite cast iron was as follows.

TABLE 7

| C | Si | Mn | P |
|---|---|---|---|
| 3.66 | 2.15 | 0.41 | 0.027 |
| S | Cu | Mo | Mg |
| 0.009 | 0.54 | 0.30 | 0.044 |

Figure 2A:
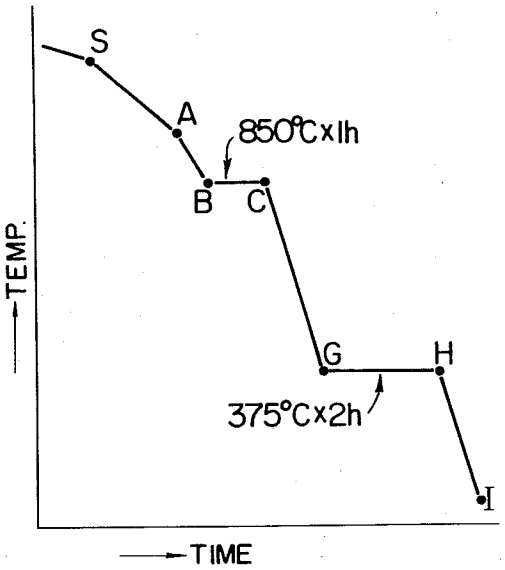
FIGS. 2*a*, 2*b* and 2*c* are graphs showing the thermal histories of cast iron in accordance with a fourth, fifth and sixth embodiment of the invention, respectively.

This melt was cast in a sand mold of the same size as that used in Embodiment 1, at a temperature of 1400° to 1420° C. The casting after the solidification was treated in the same manner as Embodiment 1 down to a point C, as will be understood from FIG. 2*a*. Subsequently, the casting was cooled down to a point G at such a rate as not to permit the generation of pearlite structure and, after having been held for 2 hours at 375° C. within the range between points G and H, cooled down to a point I at normal temperature. The casting was then subjected to a mechanical testing, the result of which is shown in Table 8 below.

TABLE 8

| tensile strength (kg/mm²) | yield strength (kg/mm²) | elongation (%) |
|---|---|---|
| 107.6 | 73.4 | 10.8 |
| 108.3 | 73.7 | 11.4 |

| Hardness (BHN) | impact strength (un-notched specimen) (kgf-m/cm²) |
|---|---|
| 293 | 10.96 |
| 285 | 11.92 |

Figure 4A:
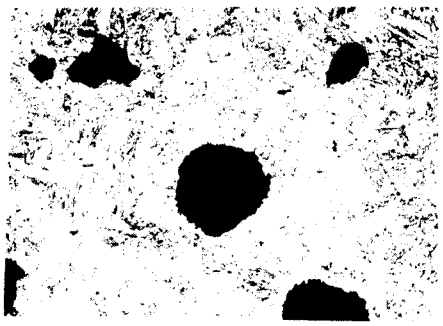
FIGS. 4*a*, 4*b* and 4*c* are photos of microstructures (magnification 400) of nodular cast iron produced in accordance with the fourth, fifth and sixth embodiment of the invention respectively.

This casting had a microstructure as shown in FIG. 4*a*.

EMBODIMENT 5

The chemical composition (wt%) of the melt of nodular graphite cast iron was as follows.

TABLE 9

| C | Si | Mn | P |
|---|---|---|---|
| 3.66 | 2.19 | 0.40 | 0.024 |
| S | Cu | Mo | Mg |
| 0.009 | 0.49 | — | 0.039 |

Figure 2B:
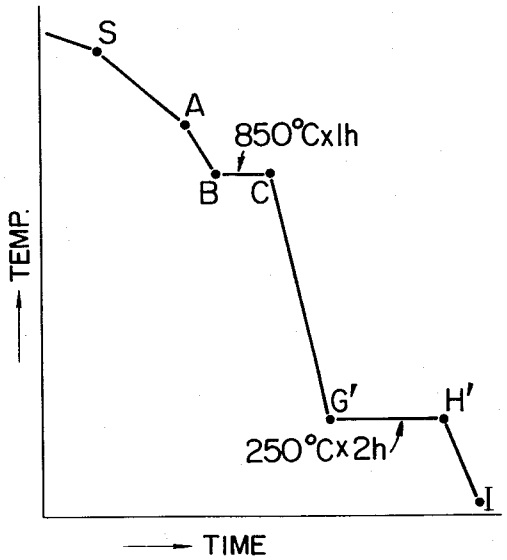

This melt was cast in a sand mold of the same size as Embodiment 1 at a temperature of 1400° to 1420° C. The casting after the solidification was treated in the same manner as Embodiment 1 to a point C as shown in FIG. 2*b*. The casting was then rapidly cooled to a point G′ (250° C.) at such a rate as not to permit the generation of pearlite structure, and, after having been held at 250° C. for 2 hours between the points G′ and H′, cooled down to a point I of normal temperature. The result of the mechanical testing is as follows.

TABLE 10

| tensile strength (kg/mm²) | yield strength (kg/mm²) | elongation (%) |
|---|---|---|
| 117.4 | 83.4 | 2.4 |
| 115.6 | 84.4 | 2.1 |

| Hardness (BHN) | impact strength (un-notched specimen) (kgf-m/cm²) |
|---|---|
| 415 | 2.75 |
| 429 | 2.56 |

Figure 4B:
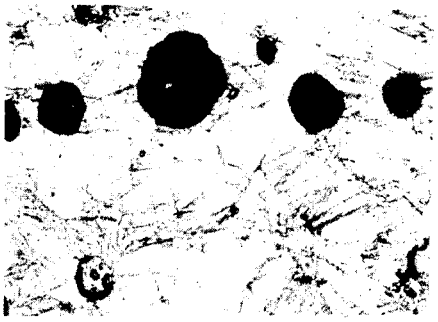

This casting had a microstructure as shown in FIG. 4*b*.

EMBODIMENT 6

The chemical composition (wt%) of the melt of nodular graphite cast iron was as follows.

TABLE 11

| C | Si | Mn | P |
|---|---|---|---|
| 3.61 | 2.09 | 0.41 | 0.025 |
| S | Cu | Mo | Mg |
| 0.010 | 0.55 | 0.28 | 0.043 |

Figure 2C:
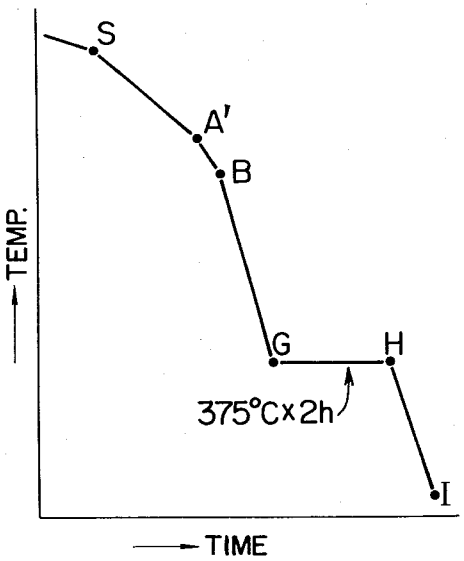

This melt was cast in a sand mold of the same size as that used in Embodiment 1, at a temperature of 1400° to 1420° C. As shown in FIG. 2*c*, the casting after the solidification was cooled within the mold down to a point A′ (870° C.). Then, after having been removed from the mold, the casting was rapidly cooled immediately from the point B (850° C.) to a point G, i.e. without being held at 850° C. for 1 hour, at such a cooling rate as not to permit the generation of pearlite structure. The casting was then treated in the same manner as Embodiment 4.

The result of the mechanical testing is shown in Table 12 below.

TABLE 12

| tensile strength (kg/mm²) | yield strength (kg/mm²) | elongation (%) |
|---|---|---|
| 101.3 | 69.0 | 10.1 |
| 103.1 | 70.1 | 9.3 |

| Hardness (BHN) | impact strength (un-notched specimen) (kgf-m/cm²) |
|---|---|
| 302 | 10.15 |
| 311 | 9.75 |

Figure 4C:
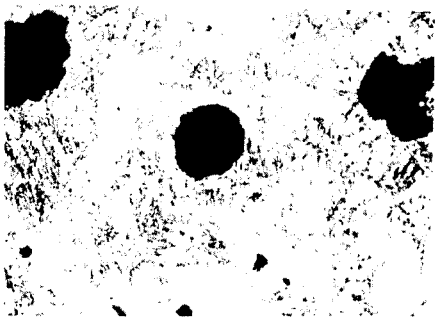

This casting had a microstructure as shown in FIG. 4*c*.

As has been described, the nodular graphite cast iron produced in accordance with the method of the invention has a matrix structure essentially consisting of bainite and exhibits extremely superior mechanical properties such as tensile strength, yield strength, elongation and impact strength.

As will be fully understood from the foregoing description, the invention provides a method of producing nodular graphite cast iron, which offers not only the economical advantages such as shortening of the production process and reduction in the production cost by the elimination of reheating, but also technical advantages such as stable production of nodular graphite cast iron having superior properties such as high strength and toughness.

Although the invention has been described through specific terms, it is to be noted here that the described embodiments are only illustrative and changes and modifications are possible within the scope of the invention which is limited solely by the appended claims.

What is claimed is:

1. A method of producing nodular graphite cast iron comprising:

pouring a melt having a nodular graphite cast iron composition into a mold;

solidifying the melt in the mold to form a casting;

removing the casting from the mold at a predetermined temperature above the $A_1$ transformation temperature;

rapidly cooling the casting at a cooling rate sufficient to prevent the generation of pearlite;

stopping the rapid cooling at a temperature above the $M_S$ point;

substantially isothermally transforming the casting to form a matrix structure consisting essentially of bainite; and cooling the casting to normal temperature.

2. The method of claim 1, wherein the step of substantially isothermally transforming the casting comprises holding the casting at an essentially constant temperature of approximately 300° C. for longer than 0.5 hours.

3. The method of claim 1, wherein the step of substantially isothermally transforming the casting comprises slowly cooling the casting from a temperature of approximately 300° C.

4. The method of claim 3, wherein the casting is slowly cooled from a temperature of approximately 300° C. at a rate of about 20° C./hour for about two hours.

5. A method of producing nodular graphite cast iron comprising:

pouring a melt having a nodular graphite cast iron composition into a mold;

solidifying the melt in the mold to form a casting;

removing the casting from the mold at a predetermined temperature above the $A_1$ transformation temperature;

holding and soaking the casting for 0.5 to 3 hours within the austenite temperature range of 830° to 900° C.;

rapidly cooling the casting at a cooling rate sufficient to prevent the generation of pearlite;

stopping the rapid cooling at a temperature above the $M_S$ point;

substantially isothermally transforming the casting to form a matrix structure consisting essentially of bainite; and cooling the casting to normal temperature.

6. The method of claim 5, wherein the step of substantially isothermally transforming the casting comprises holding the casting at an essentially constant temperature of approximately 300° C. for longer than 0.5 hours.

7. The method of claim 5, wherein the step of substantially isothermally transforming the casting comprises slowly cooling the casting from a temperature of approximately 300° C.

8. The method of claim 7, wherein the casting is slowly cooled from a temperature of approximately 300° C. at a rate of about 20° C./hour for about two hours.

* * * * *